US006626560B1

(12) United States Patent
Caferro et al.

(10) Patent No.: US 6,626,560 B1
(45) Date of Patent: Sep. 30, 2003

(54) LIGHTING LOUVER

(76) Inventors: Ronald N. Caferro, E. 9919 Montgomery, Spokane, WA (US) 99206; Edward N. Caferro, 2503 E. 39th, Spokane, WA (US) 99223

( * ) Notice: Subject to any disclaimer, the term of this patent is extended or adjusted under 35 U.S.C. 154(b) by 0 days.

(21) Appl. No.: 09/721,401

(22) Filed: Nov. 22, 2000

(51) Int. Cl.[7] ..... F21V 9/00

(52) U.S. Cl. ..... 362/290; 362/216; 362/217; 362/225; 362/235; 362/291; 362/292

(58) Field of Search ..... 362/216, 217, 362/225, 235, 290, 291, 292, 260, 267, 325, 342, 347, 349, 354, 362

(56) References Cited

U.S. PATENT DOCUMENTS 4,429,354 A 1/1984 Garnett
4,621,309 A 11/1986 Grawe et al.
4,907,143 A * 3/1990 Lasker ..... 362/225
5,008,791 A * 4/1991 Caferro ..... 362/290
5,029,059 A * 7/1991 Grimm ..... 362/290

FOREIGN PATENT DOCUMENTS

DE 0138747 10/1984
WO WO96/25623 8/1996

* cited by examiner

*Primary Examiner*—Sandra O'Shea
*Assistant Examiner*—M. Tsidulko
(74) *Attorney, Agent, or Firm*—Wells St. John P.S.

(57) ABSTRACT

A lighting louver and process steps for forming at least portions of a louver are described in which the louver may include a "V" shaped louver body with opposed sides that diverge from a narrow end that include a vertex of the "V" shape, to a wide end. At least one integral hinge at the narrow end joins medial portions of the opposed sides along a singular fold line. The medial portions contact one another at a location adjacent to the singular fold line. At least one inward closure tab overlaps the wide end of the louver body.

16 Claims, 6 Drawing Sheets

LIGHTING LOUVER

TECHNICAL FIELD

The present invention relates to lighting louvers and processes for making such louvers.

BACKGROUND OF THE INVENTION

There are many forms of lighting louvers, manufactured using various methods, for visually hiding light sources such as elongated fluorescent bulbs and for evenly dispersing light over a given area by reflecting light from the source from parabolic reflective surfaces. Some louvers are made of polymers that are injection molded into grid or other forms. Molds for such louvers are very expensive and do not allow for much variance in design for the resulting louver grids. Other louvers are formed of metal such as specular aluminum in individual louver sections that may be fitted together to form a complete lighting panel. This adds significant capability for the lighting designer to alter the appearance and effect of the finished panels, since the sections may be assembled in a variety of ways. Still, the manufacturing process is fairly complex and generally requires sophisticated formation and assembly machinery. This has been due at least in part to the nature of the folded type louver.

In the past, the louver shape has been stamped or otherwise cut from sheet stock, then bent into the desired configuration about numerous fold lines to arrive at the final shape for assembly with other louver sections. The material must be precisely bent about the fold lines for the final shape of the louver to be acceptable. If the folds are not precisely made, the resulting louver may not be of an acceptable shape to be used in a panel.

The drawings exemplify a prior art louver in FIGS. 1 and 2 that is formed about two fold lines at a top portion of the louver. FIG. 2 indicates the location of the two fold lines by dashed lines. If the bending procedure is not precise along both fold lines, the resulting louver shape may result in uneven or misaligned bottom marginal edges (the arcuate outer edges in FIG. 2).

Uneven edges at the bottom or outward edges of the louver are unsightly and can result in undesired specular inefficiency of the louver by reflecting light in undesired directions. It is also typical that the top or inside portions are slotted. Open slots result in inefficiency because light captured within the louver body cannot escape.

It is therefor desirable to simplify louver construction to enable use of simple machinery and to better assure a more consistent and acceptable finished louver.

It is also desirable to obtain a louver with a top or wide end portion that is closed in order to maximize specular efficiency by avoiding trapping of light within the louver interior.

A need also exists for a louver that may be formed with top or wide end surfaces that are recessed between louver ends to enable mounting of the louver in close proximity to a light source such as fluorescent lighting tubes.

The present louver, as will be understood from the following description, provides solutions to the above problems and fulfills the above noted needs.

BRIEF DESCRIPTION OF THE DRAWINGS

Preferred embodiments of the invention are described below with reference to the following accompanying drawings.

FIG. 4 is an enlarged detail view of the area identified by the numeral 4 in FIG. 3;

FIG. 7 shows a step in which the opposed sides of the louver are folded about the fold line in the direction indicated by the arrows therein; and FIGS. 8–11 show alternate examples of louver shapes incorporating aspects of the present invention.

DESCRIPTION OF THE PREFERRED EMBODIMENTS

Figure 2:
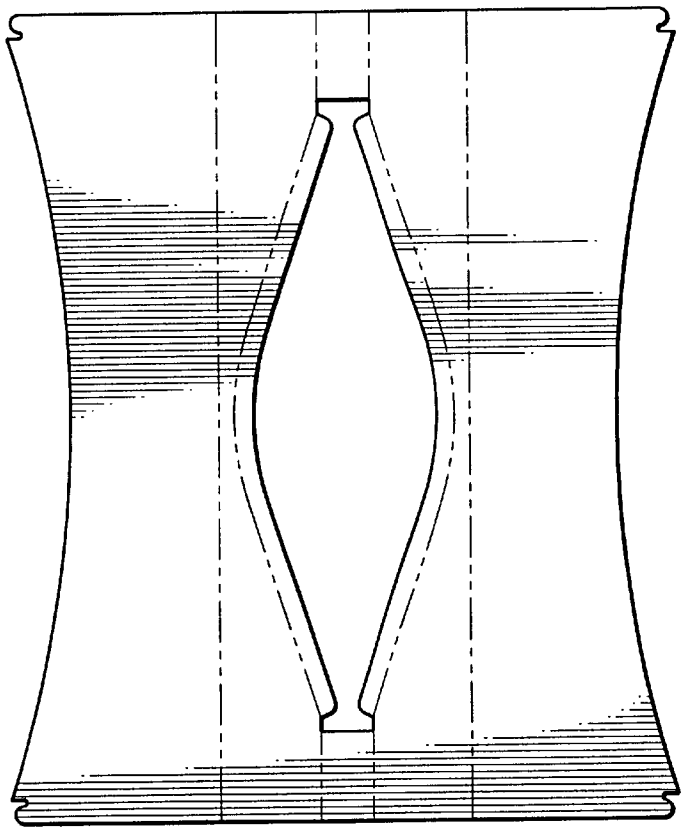
FIG 2 PRIOR ART
FIG. 2 is a diagrammatic view of a flat pattern for the prior art louver configuration shown in FIG. 1.
Figure 1:
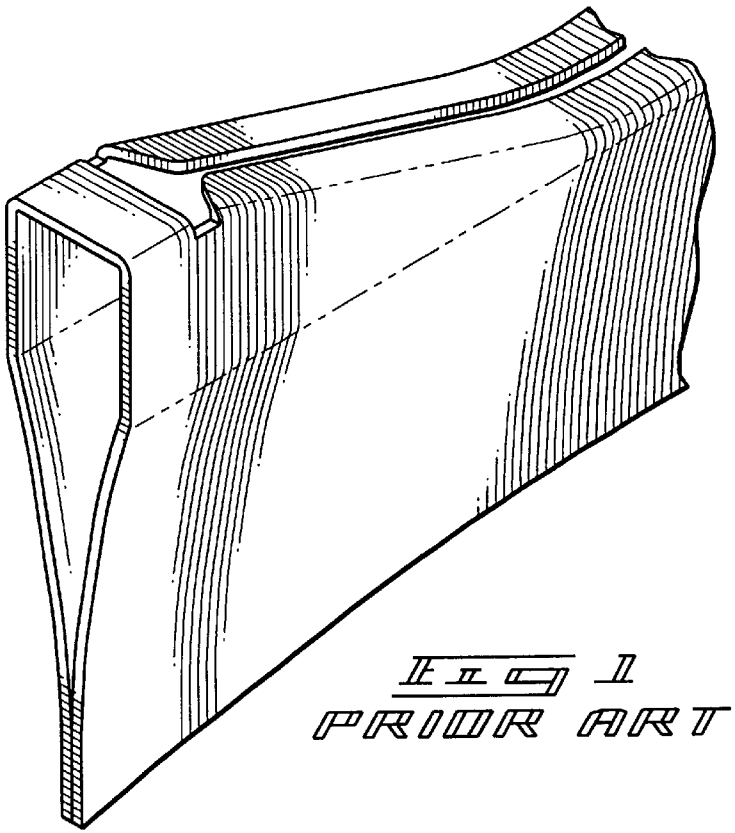
FIG 1 PRIOR ART
FIG. 1 is a diagrammatic perspective view of a portion of a prior art louver.
Figure 2:
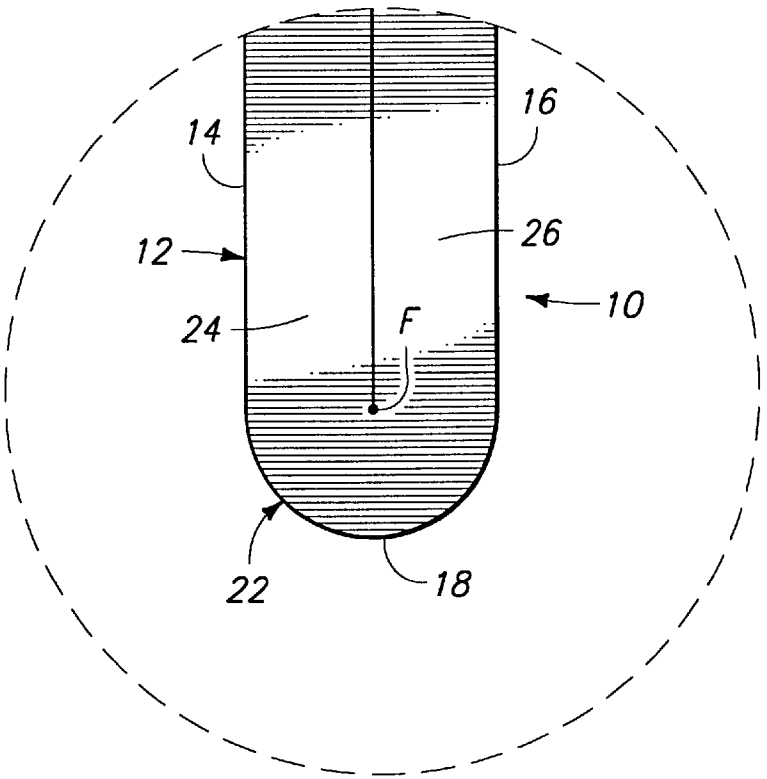

This disclosure of the invention is submitted in furtherance of the constitutional purposes of the U.S. Patent Laws "to promote the progress of science and useful arts" (Article 1, Section 8).

GENERAL DESCRIPTION

In a first aspect of the invention, a lighting louver 10 includes a "V" shaped louver body 12 including opposed sides 14, 16 diverging from a narrow end 18 including a vertex of the "V" shape, to a wide end 20. At least one integral hinge 22 is provided at the narrow end, joining medial portions 24, 26 of the respective opposed sides 14, 16 along a singular fold line F. The medial portions 24, 26 contact one another at a location adjacent to the singular fold line F. At least one inward closure tab 28 overlaps the wide end 20.

In another aspect, the lighting louver 10 includes a "V" shaped louver body 12 including opposed sides 14, 16 that are folded about a singular fold line F at a narrow end 18 of the body 12 including a vertex of the "V" shape. The sides 14, 16 diverge from the narrow end 18 to a wide end 20. Medial portions 24, 26 of the respective opposed sides 14, 16 are situated adjacent the narrow end 18 and are formed about the singular fold line F through an angle of approximately 180° such that the medial portions 24, 26 are at least in close proximity. At least one integral hinge 22 is bent in an arc about the singular fold line at the narrow end 18 and joins the medial portions 24, 26 on opposite sides of the fold line F. The medial portions 24, 26 terminate at marginal edges 30, 32 that are disposed to at least one side of the hinge 22 along the fold line F. At least one closure tab 28 is integral with the louver body and is folded to overlap the wide end 20.

In another aspect, the lighting louver 10 includes a "V" shaped louver body 12 that includes opposed sides 14, 16 diverging from a narrow end 18 including a vertex of the "V" shape, to a wide end 20. A pair of hinges 22 are integral with the louver body 12 at the narrow end 18, joining the opposed sides 14, 16 along a single fold line F, and juxtaposed marginal edges 30, 32 join the hinges and extend along the fold line F. At least one closure tab 28 is integral with the louver body 12, folded across and spanning the wide end 20.

In a still further aspect, a process for forming the lighting louver, includes steps of: forming a sheet 34 of ductile material into a flat pattern 36 including opposed louver sides 14, 16 joined by at least one integral hinge element 22 situated along a single reference fold line F; forming at least one slot 38 in the material, the slot 38 being defined by opposed marginal edges 30, 32 that are symmetrical on opposite sides of the single reference fold line F and that are disposed to at least one side of the at least one integral hinge element 22; forming at least one closure tab 28 along the sheet 34 and laterally spaced from the marginal edges 30, 32 with respect to the single reference fold line F; bending the sheet along the fold line F into a "V" shaped configuration with a wide end 20 and with a narrow end 18 including the at least one integral hinge element 22 at a vertex of the "V" shape and with the marginal edges 30, 32 in juxtaposition; and bending the at least one closure tab 28 to at least partially span the wide end 20.

In a still further aspect, a process for forming the lighting louver, comprises the steps of: obtaining a sheet 34 of ductile material in a flat pattern 36 including opposed louver sides 14, 16 joined by at least one integral hinge element 22 along a single reference fold line F and having at least one slot 38 formed therein defined by marginal edges 30, 32 extending alongside the single reference fold line F, with the marginal edges 30, 32 being disposed to at least one side of the at least one integral hinge element 22, and with at least one closure tab 28 spaced laterally from the marginal edges 30, 32; bending the sheet 34 along the single fold line F into a "V" shaped configuration with a narrow end 18 at a vertex of the "V" shape including the at least one integral hinge element 22 and with medial portions 24, 26 of the sheet 34 adjacent the marginal edges 30, 32 in juxtaposition; and bending the at least one closure tab 28 to span a wide end 20 of the "V" shape.

In another aspect, and within a process for forming a lighting louver, a sub-assembly process includes the steps of forming a sheet of ductile material into a flat pattern including opposed louver sides joined by at least one integral hinge element situated along a single reference fold line; and forming at least one slot in the material, the slot being defined by opposed marginal edges formed along the single reference fold line and that extends to at least one side of said at least one integral hinge element to facilitate ease of folding the opposed louver sides into a "V" shaped louver.

In a still further aspect within a process for forming a lighting louver, steps include obtaining a sheet of ductile material having been formed into a flat pattern including opposed louver sides joined by at least one integral hinge element situated along a single reference fold line, and with at least one slot defined by opposed marginal edges formed along the single reference fold line and that extends to at least one side of said at least one integral hinge element to facilitate ease of folding the opposed louver sides into a "V" shaped louver; and folding the opposed louver sides into the "V" shaped louver.

DETAILED DESCRIPTION

In preferred forms, the present louver 10 is formed of a thin ductile specular material such as specular aluminum in which the flat pattern 36 is die stamped, laser cut, water cut or otherwise formed. As exemplified in FIG. 5, a succession of the flat patterns for a number of louvers may be formed along a single sheet 36 for later removal or separation to produce a number of individual louvers 10. Alternatively, single patterns may be formed on single sheets for formation into finished louvers 10. Sheet thickness and reflective properties may be selected from commercially available stock that is typically used in lighting louver manufacture.

Figure 3:
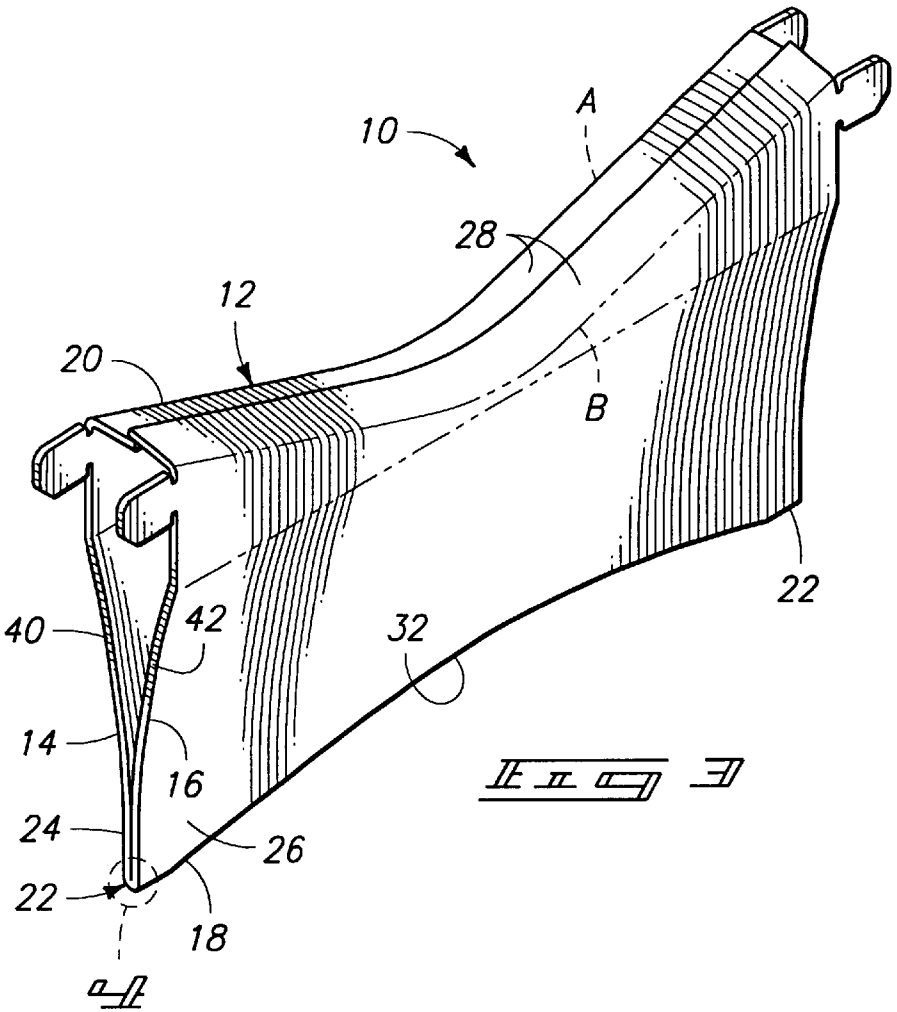
FIG. 3 is a perspective view of a first preferred louver configuration of the present invention.

In referring to FIGS. 3 and 4, a preferred louver 10 may include the opposed sides 14, 16 with parabolic curvatures 40, 42 that may be of a conventional nature typical of what are commonly known in the lighting arts as "parabolic louvers". The parabolic curvatures may be formed in the sheet material prior to louver formation, by an appropriate conventional press technique or by roll forming to shape the sheet or successive sheets with the curvatures 40, 42 substantially as exemplified in FIG. 5.

The curvatures 40, 42 may be symmetrical as shown, or be asymmetrical according to the needs of the ultimate user. Alternatively, one side may include a parabolic curvature and the opposite side may be flat or otherwise shaped. Still further, it is possible to produce the present louver without curvature along either of the sides 14, 16.

The preferred hinge 22 is an integral part of the louver body 12 and, as shown in FIG. 4, preferably joins medial portions 24, 26 of the opposed sides 14, 16 along the singular fold line F. The hinge 22 will preferably cross the fold line F to join the opposed sides to connect the sides and facilitate folding about the fold line F.

Figure 11:
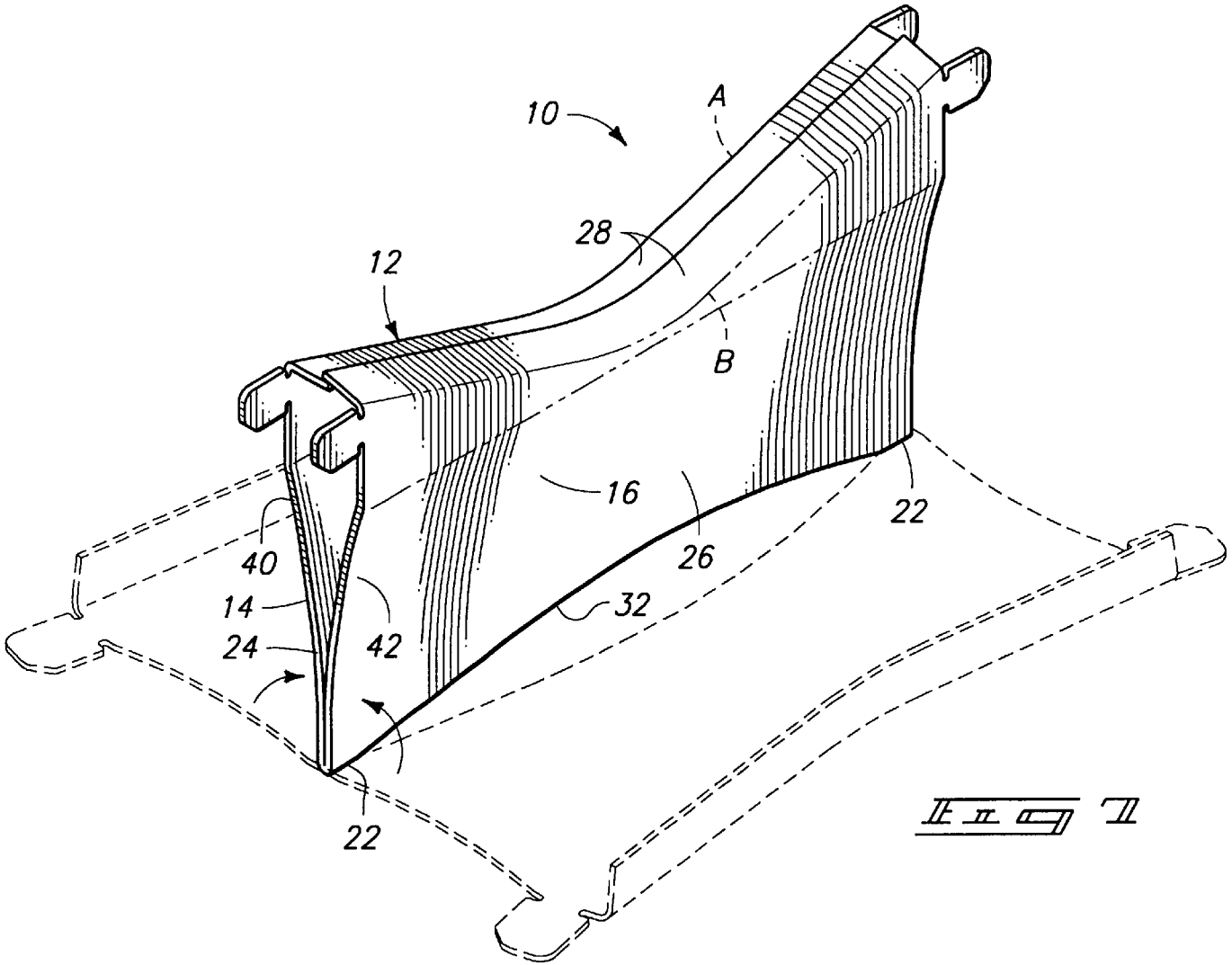
Figure 9:
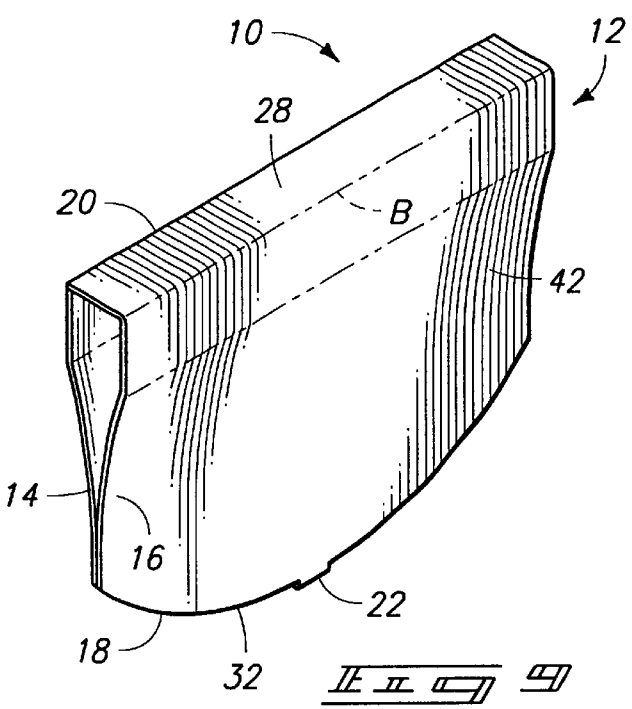
Figure 8:
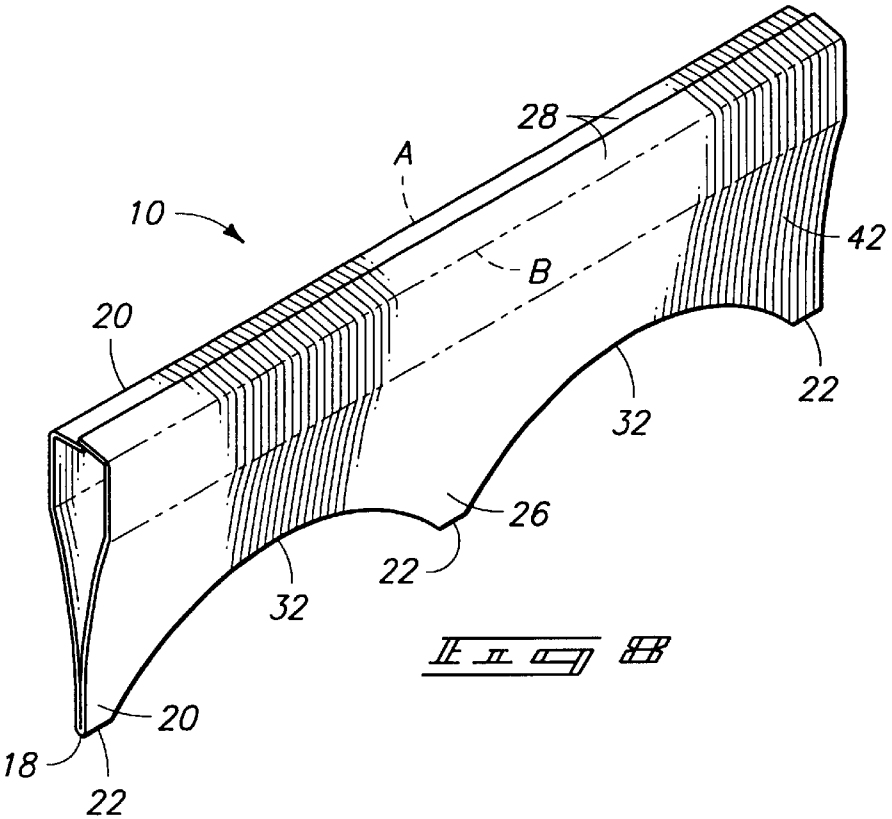
Figure 3:
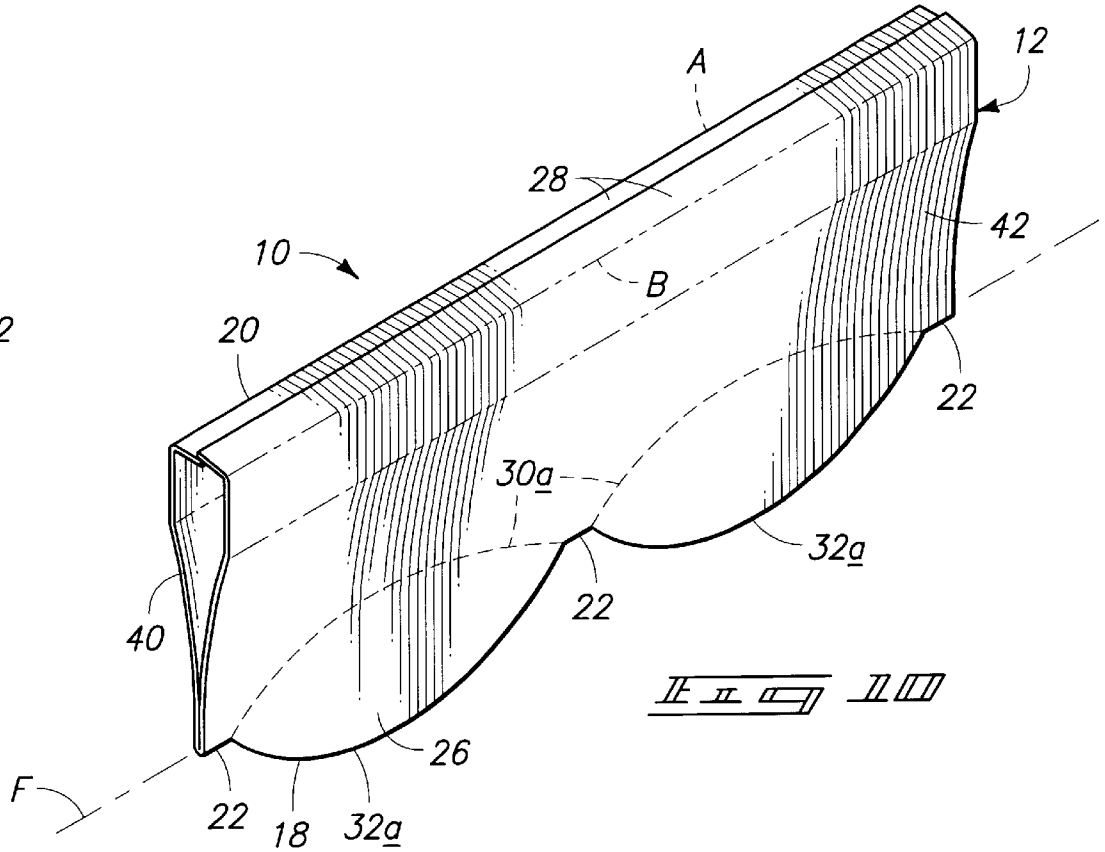
Figure 2:
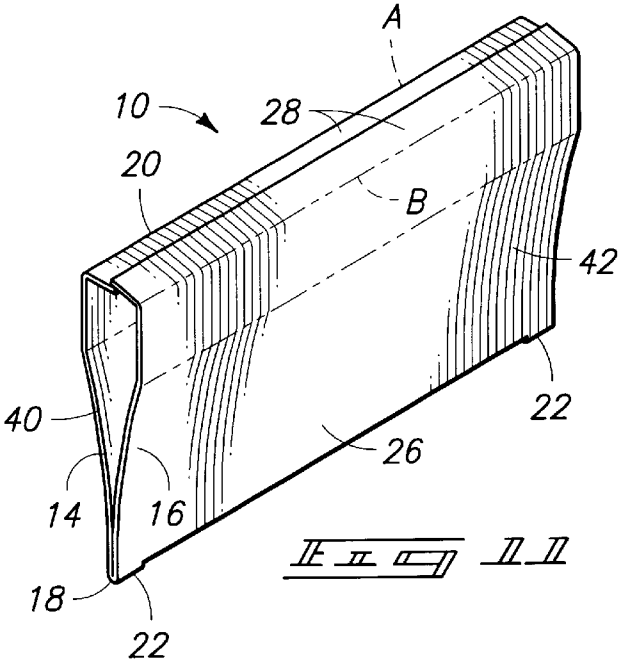

As indicated above, preferred forms of the present louver include at least one hinge 22 to join the sides and to allow folding of the opposed sides 14, 16. FIG. 9 indicates an exemplary embodiment in which a singular hinge 22 may be used. FIGS. 3, 8, and 11 indicate exemplary embodiments in which multiple hinges 22 may be used.

In embodiments in which more than one hinge 22 is provided, it is most preferable that the hinges 22 be aligned along the single fold line F. It is also preferred that the hinges be symmetrical on opposed sides of the fold line. With this provision, accurate folding of the opposed sides may be easily accomplished since the hinges will function as a guide. Likewise, in embodiments where a singular hinge is used, the extent of the hinge portion will most preferably be aligned with the fold line.

FIG. 4 is an enlarged end view of the medial portions 24, 26 that are adjacent the fold line F (which appears as a point in FIG. 4). It is noted that the fold line F in this preferred example lies along a surface of the louver body and forms the center axis of the bend at the vertex of the "V" shaped louver configuration. To form the vertex, it is preferable that the sides 14, 16 be bent or folded through an angle of approximately 180°, or approximately 90° for each side 14, 16 about the fold line F.

In preferred forms, the bend radius for the facing surfaces of the medial portions 24, 26 approaches zero, and the outward facing surfaces have a bend radius approximately equal to the thickness of the louver material. With such bend radii, the medial portions 24 and 25 will be juxtaposed or touch one another at points adjacent the fold line F. In embodiments in which the sides 14 and 16 are provided with parabolic curvatures, the medial portions 24, 26 will contact substantially tangentially at the fold line, as may be understood by viewing FIG. 3, then separate gradually with the desired parabolic curvature toward the wide end 20.

In preferred forms in which one or more slots 38 are formed in the sheet 34, defined by the opposed marginal edges 30, 32. The slot or slots 38 preferably extend from at least one side of an adjacent hinge 22 and along the fold line F. In preferred forms, the slot or slots are disposed between successive hinges. The slot width and shape may vary according to the desired shape of the folded narrow end 18.

FIGS. 3 and 8–11 indicate different narrow end configurations that may result from different slot configurations. The slot 38 may thus vary from a simple straight line cut into the sheet 34 (between hinge members 22 and along the fold line F) to various curves and other cut or stamped shapes, some examples of which are illustrated by FIGS. 3 and 8–11.

Figure 5:
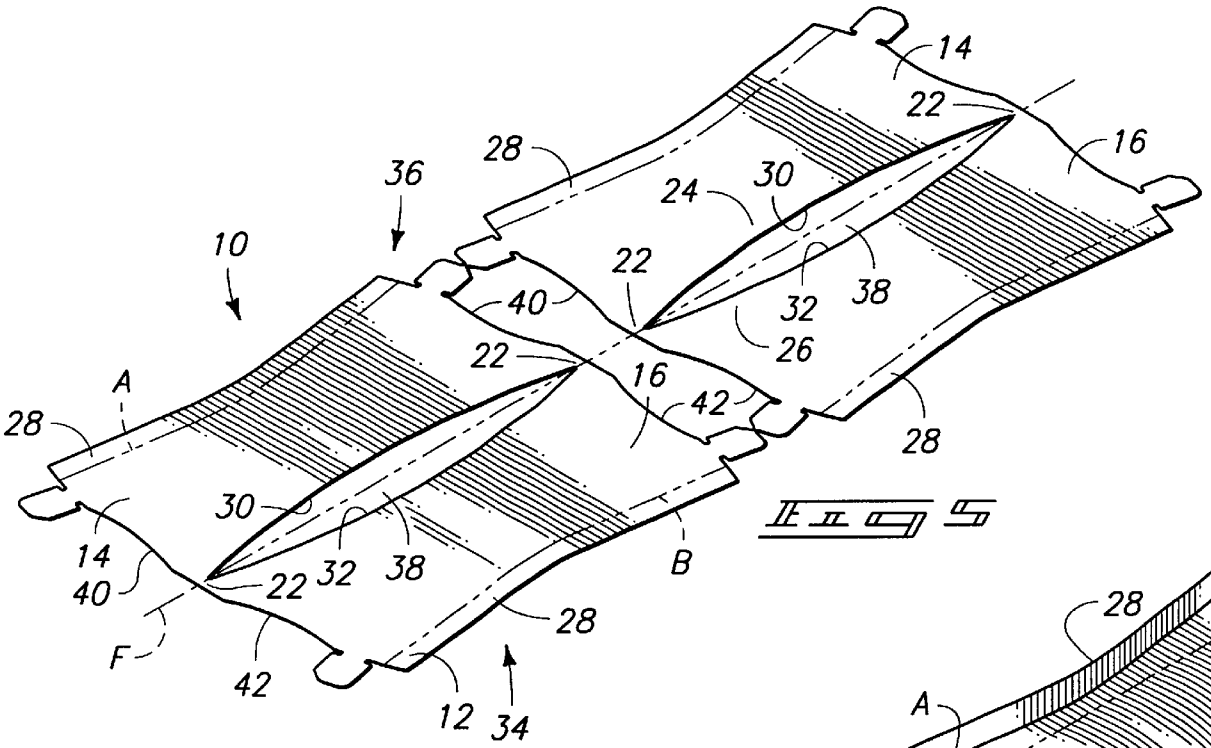
FIG. 5 is a perspective view of a sheet from which the flat patterns of a louver pair have been formed.

The slot or slots .38 are most preferably symmetrical about the fold line F. Preferably, each slot 38 is arranged as shown in FIG. 5, so the marginal edge 30 on one side of the fold line F is preferably a mirror image of the marginal edge 32 on the opposite side of the fold line F. While this is a preferred arrangement, other arrangements may be used in which the marginal edges are not at least initially symmetrical about the fold line at least when the sheet begins in the flat pattern.

It is possible for embodiments of the louver to include edges that are non-symmetrical about the fold line, at least in the flat pattern. Non-symmetrical marginal edges may align when the louver sides are folded. The example shown in FIG. 11 indicates such a configuration, with the concave edges 30*a* shown by hidden lines being out of alignment with convex edges 32*a*. The flat pattern for this configuration would have both edges in a nested configuration and the slot would simply consist of a curved cut formed through the sheet material extending from one hinge 22 to the next. When the sheet is folded, the edges will separate as shown, in symmetry about the fold line F.

In the more preferred configurations in which the slot and marginal edges are symmetrical about the fold line F when the sheet is in the flat pattern configuration, and afterward when the sheet is folded about the fold line F, the symmetrical marginal edges 30, 32 will be in juxtaposition and be aligned laterally with respect to the fold line F. Precise juxtaposition and alignment is most accurately assured by reason of the adjacent hinge or hinges 22 that serve to hold the marginal edges 30, 32 in such symmetry during bending and in aligned juxtaposition once the bend is completed.

It is noted that the slot or slots 38 and marginal edges 30, 32 may take numerous other configurations. FIG. 3, for example the slot forms marginal edges that produce a concave shape along the narrow end 18 of the louver body 12 when the sheet is folded. FIG. 8 exemplifies a pair of slots separated by three hinges wherein the marginal edges that define the slots form two concave surfaces when the sheet is folded. FIG. 9 exemplifies a single hinge 22 with slots to opposed sides, defining marginal edges that form a convex shape when the sheet is folded. FIG. 10 shows two hinges 22 and an elongated slit or very narrow slot that results in a substantially straight, narrow end when the sheet is folded. FIG. 11 as explained above, is an example in which concave marginal edges 30*a* are on one side of the louver body, and the opposed convex marginal edges 32*a*are on the opposite side of the louver body with the fold line F between the two. These examples are given to indicate samples of the variety of shapes that may be produced along the narrow louver end 18 by provision of the preferred hinge arrangements and selected slot (and marginal edge) configurations. Other configurations could also be produced.

It is preferred that the wide end 20 be closed by provision of one or more closure tabs 28. At least one closure tab 28 is provided on one of the sides 14 or 16 that may be folded to overlap the wide end 20 of the louver body. In the example illustrated in FIG. 3, two closure tabs 28 are provided and are folded to overlap the wide end 20 and to slightly overlap one another. In the example illustrated in FIG. 9 one closure tab 28 is provided and is folded across the wide end 20. In either example, the otherwise open part at the wide end 20 of the "V" shaped louver body is closed. This is done to maximize specular efficiency of the louver body by preventing loss of light that would otherwise be received within the confined area between the sides 14, 16.

The closure tabs may be of a desired configuration, as may be their associated fold lines A and B. In the examples illustrated, the tab fold lines A and B are parallel with one another. In the preferred forms illustrated by FIGS. 3 and 7, the fold lines A and B are curved so the closure tabs will produce a concave shape at the wide end when the louver is folded.

It is also quite possible for fold lines A and B to be straight and parallel as exemplified by FIGS. 8–11. Whatever shape is selected for the closure tabs, the finished wide end of the louver is most preferably covered by the folded tab or tabs 28 and the width dimension is most preferably consistent along the full length of the louver.

Figure 6:
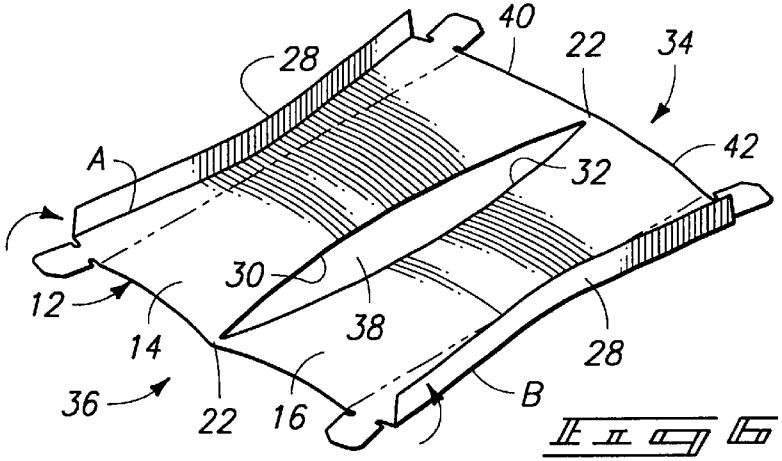
FIG. 6 shows a step in forming a preferred louver in which closure tabs are folded from the flat pattern in the direction indicated by the arrows.

The preferred process may be accomplished to produce a sub-assembly by forming the flat pattern 36 and bending the sides and tab or tabs to form the louver substantially in the configuration shown by FIG. 6. With steps taken to produce such a sub-assembly, the partially formed louver blanks may be easily stacked and shipped in a compact condition and in great numbers to a remote site where the remaining steps may be completed without requiring sophisticated equipment or expertise.

The patterns 36 may thus be formed by one manufacturer at one site and be easily transported for completion of the bending steps at another location. The hinge arrangement and location of the hinge or hinges facilitates completion of the louver by allowing the necessary bending steps to be performed without requiring sophisticated bending equipment. In fact, it is possible that bending steps may be preformed by hand.

In another aspect, a sub-assembly may be used as a starting point for completing formation of the louver. The steps in this aspect may begin with a previously formed flat pattern 36, and end with the louver completely formed. The steps involved simply include obtaining the pre-formed flat pattern 36, and folding the louver sides about the fold line F. This step is graphically demonstrated by FIG. 7, and may be accomplished by hand or by use of very simple bending jigs. There is no need of specialized equipment since the hinge or hinges 22 will guide and maintain the sides in proper alignment as the fold is made.

In a further aspect, a combination of process steps may include forming the ductile sheet 34 into the desired flat pattern 36, then bending the sheet along the fold line F into a "V" shaped configuration with a wide end 20 and with a narrow end 18 including the at least one integral hinge element 22 at a vertex of the "V" shape and with the marginal edges 30, 32 in juxtaposition; and bending the at least one closure tab 28 to at least partially span the wide end 20.

Formation of the pattern 36 may include steps taken to produce opposed louver sides 14, 16 joined by at least one integral hinge element 22 situated along a single reference fold line F, and forming at least one slot 38 in the material. In preferred forms, the slot 38 may be defined by opposed marginal edges 30, 32 that are symmetrical on opposite sides of the single reference fold line F and that are disposed to at least one side of the at least one integral hinge element 22. The process may also include forming at least one of the closure tabs 28 along the sheet 34. Finishing the louver may be accomplished by bending the sheet along the fold line F into the described "V" shape through use of a simple bending mandrel or die (not shown), and by similarly bending the tab or tabs 28.

Thus, as indicated above, it is possible that the louvers may be formed in a number of different ways, none of which require use of sophisticated or expensive equipment beyond that needed to make the flat pattern. Yet, by reason of the singular fold line F and the particular hinge placement, accuracy in the steps leading to completion of the louver may be fairly assured. This is primarily due to the nature and location of the hinge portions 22. The medial portions 24, 26 may be bent about the fold line F through an angle of approximately 180° so facing surfaces of the portions will come into abutment, and the tab or tabs 28 (if previously bent) will come together to span the wide end of the resulting "V" shape. The louver is now finished and in condition for assembly with other louvers to form a lighting panel.

In the aspect of the process in which the louver flat pattern is provided in a pre-formed condition, the steps to complete the finished louver may be accomplished by bending the sheet 34 (including the hinge or hinges 22) along the single fold line F. The pre-formed sheet 34 is preferably folded into the "V" shaped configuration so the medial sheet portions 26, 28 are juxtaposed adjacent the marginal edges 30, 32. The steps may also include bending the closure tab or tabs 28 to span the wide end 20 of the "V" shape. Once again, the process requires no expensive or sophisticated machinery to perform the steps. The centrally located hinge or hinges 22 will aid by guiding the folding accurately about the fold line F.

The above process steps may be accomplished with any of the exemplary louver configurations shown and described herein, and for others that may be produced from the teachings herein.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A lighting louver, comprising:

a "V" shaped louver body including opposed sides folded about a singular fold line at a narrow end of the body including a vertex of the "V" shape, the sides diverging from the narrow end to a wide end;

wherein medial portions of the opposed sides are situated adjacent the narrow end and are formed about the singular fold line through an angle of approximately 180° such that the medial portions are at least in close proximity;

at least one integral hinge bent in an arc about the singular fold line at the narrow end and joining the medial portions on opposite sides of the fold line and;

wherein the medial portions terminate at marginal edges that are disposed to at least one side of the hinge along the fold line; and at least one closure tab that is integral with the louver body and folded to overlap the wide end; and.

further wherein there are at least two integral hinges and wherein the marginal edges extend between successive integral hinges.

2. A lighting louver, comprising:

a "V" shaped louver body including opposed sides diverging from a narrow end including a vertex of the "V" shape, to a wide end;

a pair of hinges that are integral with the louver body at the narrow end, joining the opposed sides along a single fold line, and juxtaposed marginal edges joining the hinges and extending along the fold line; and at least one closure tab that is integral with the louver body folded across and spanning the wide end.

3. A lighting louver as defined by claim 2 wherein the hinges are aligned along the single fold line.

4. A lighting louver as defined by claim 2 further comprising a slot formed in the louver body and defined by marginal edges that extend between the pair of hinges.

5. A lighting louver as defined by claim 2 further comprising a slot formed in the louver body and defined by marginal edges that extend between the pair of hinges and that are juxtaposed and aligned laterally with respect to the fold line.

6. A process for forming a lighting louver, comprising the steps of:

forming a sheet of ductile material into a flat pattern including opposed louver sides joined by at least one integral hinge element situated along a single reference fold line;

forming at least one slot in the material, the slot being defined by opposed marginal edges that are symmetrical on opposite sides of the single reference fold line and that are disposed to at least one side of said at least one integral hinge element;

forming at least one closure tab along the sheet and laterally spaced from the marginal edges with respect to the single reference fold line;

bending the sheet along the fold line into a "V" shaped configuration with a wide end and with a narrow end including said at least one integral hinge element at a vertex of the "V" shape and with the marginal edges in juxtaposition; and bending said at least one closure tab to at least partially span said wide end.

7. The process of claim 6 including the further step of forming parabolic curvatures along the opposed louver sides.

8. The process of claim 6 wherein each louver side includes a closure tab the step of bending at least one closure tab is accomplished by bending the two closure tabs to overlap and span the wide end.

9. A process for forming a lighting louver, comprising the steps of:

obtaining a sheet of ductile material in a flat pattern including opposed louver sides joined by at least one integral hinge element along a single reference fold line and having at least one slot formed therein defined by marginal edges extending alongside the single reference fold line, with said marginal edges being disposed to at least one side of said at least one integral hinge element, and with at least one closure tab spaced laterally from the marginal edges;

bending the sheet along the single fold line into a "V" shaped configuration with a narrow end at a vertex of the "V" shape including said at least one integral hinge element and with medial portions of the sheet adjacent the marginal edges in juxtaposition; and bending said at least one closure tab to span a wide end of the "V" shape.

10. The process of claim 9 wherein the step of bending said at least one closure tab is accomplished prior to bending the sheet along the single fold line.

11. The process of claim 9 wherein the step of bending the sheet along the single fold line includes bending the opposed louver sides about the fold line through an angle of approximately 180°.

12. In process for forming a lighting louver, a sub-assembly process including the steps of:

forming a sheet of ductile material into a flat pattern including opposed louver sides joined by at least one intergral hinge element situated along a single reference fold line;

forming at least one slot in the material, the slot being defined by opposed marginal edges formed along the single refence fold line and that extends to at least one side of said at least one integral hinge element to facilitate ease of folding the opposed louver sides into a "V" shaped louver.

13. In process for forming a lighting louver, the steps of:

obtaining a sheet of ductile material having been formed into a flat pattern including opposed louver sides joined by at least one integral hinge element situated along a single reference fold line, and with at least one slot defined by opposed marginal edges formed along the single reference fold line and that extends to at least one side of said at least one integral hinge element to facilitate ease of folding the opposed louver sides into a "V" shaped louver; and folding the opposed louver sides into the "V" shaped louver.

14. A lighting louver, comprising:

a "V" shaped louver body including opposed sides diverging from a narrow end including a vertex of the "V" shape, to a wide end;

a pair of hinges that are integral with the louver body at the narrow end, joining the opposed sides along a single fold line, and juxtaposed marginal edges joining the hinges and extending along the fold line;

a slot formed in the louver body and defining the marginal edges; and at least one closure tab that is integral with the louver body folded across and spanning the wide end.

15. A lighting louver, comprising:

a "V" shaped louver body including opposed sides diverging from a narrow end including a vertex of the "V" shape, to a wide end;

at least one hinge at the narrow end, joining medial portions of the opposed sides along a fold line;

wherein the medial portions contact one another at a location adjacent to the singular fold line;

a slot formed in the louver body, defining marginal edges of the medial portions that extend along the narrow end from the integral hinge.

16. A lighting louver, comprising:

a "V" shaped louver body including opposed sides diverging from a narrow end including a vertex of the "V" shape, to a wide end;

a hinge joining medial portions of the opposed sides; and a slot formed in the louver body along the medial portions and defining marginal edges of the medial portions that extend along the narrow end.

* * * * *

UNITED STATES PATENT AND TRADEMARK OFFICE

CERTIFICATE OF CORRECTION

PATENT NO. : 6,626,560 B1
DATED : September 30, 2003
INVENTOR(S) : Caferro et al.

It is certified that error appears in the above-identified patent and that said Letters Patent is hereby corrected as shown below:

Column 5,
Line 4, replace "The slot or slots .38 are most preferably symmetrical" with -- The slot or slots 38 are most preferably symmetrical --
Line 49, replace "the opposed convex marginal edges 32aare on the opposite" with -- the opposed convex marginal edges 32a are on the opposite --

Column7,
Line 61, replace "body and folded to overlap the wide end; and." with -- body and folded to overlap the wide end; and --

Signed and Sealed this

Twenty-seventh Day of July, 2004

JON W. DUDAS
*Acting Director of the United States Patent and Trademark Office*